US007323958B2

(12) United States Patent
Auque et al.

(10) Patent No.: US 7,323,958 B2
(45) Date of Patent: Jan. 29, 2008

(54) MULTIPOLE CIRCUIT BREAKER WITH SINGLE-POLE BREAKING UNITS

(75) Inventors: Henri Auque, Saint Martin d'Uriage (FR); Marc Serpinet, Mont Chaboud (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 11/037,223

(22) Filed: Jan. 19, 2005

(65) Prior Publication Data

US 2005/0174203 A1 Aug. 11, 2005

(30) Foreign Application Priority Data

Feb. 10, 2004 (FR) ..... 04 01248

(51) Int. Cl.
*H01H 9/02* (2006.01)
*H01H 13/04* (2006.01)

(52) U.S. Cl. ..... 335/202; 335/185; 335/195

(58) Field of Classification Search ..... 335/8–10, 335/202, 185, 195; 361/652
See application file for complete search history.

(56) References Cited

U.S. PATENT DOCUMENTS 3,614,687 A * 10/1971 Iida et al. ..... 335/195
4,724,513 A * 2/1988 M'Sadoques et al. ..... 361/652
4,945,326 A * 7/1990 Kandatsu ..... 335/16
5,281,776 A 1/1994 Morel et al. ..... 200/144
6,924,721 B2 * 8/2005 Afshari et al. ..... 335/202

FOREIGN PATENT DOCUMENTS

EP 0 111 662 6/1984
FR 2 682 531 4/1993

* cited by examiner

*Primary Examiner*—Elvin Enad
*Assistant Examiner*—Bernard Rojas
(74) *Attorney, Agent, or Firm*—Steptoe & Johnson LLP

(57) ABSTRACT

Multipole circuit breaker comprising single-pole breaking units in the form of cases with two large side faces and having at least one movable contact which operates in conjunction with at least one stationary contact, an operating mechanism common to a set of breaking units to command opening or closing of the contacts of said units, first line-side electrical connection means, second load-side electrical connection means; the breaking units are grouped on two superposed layers, at least one layer comprising at least one pair of units, the operating mechanism comprising mechanical connecting means to simultaneously actuate the single-pole breaking units of each layer.

10 Claims, 4 Drawing Sheets

MULTIPOLE CIRCUIT BREAKER WITH SINGLE-POLE BREAKING UNITS

BACKGROUND OF THE INVENTION

The invention relates to a multipole circuit breaker, comprising single-pole breaking units in the form of cases with two large side faces and having at least one movable contact which operates in conjunction with at least one stationary contact, an operating mechanism common to a set of breaking units to command opening or closing of the contacts of said units, first line-side electrical connection means, and second load-side electrical connection means.

STATE OF THE ART

In known manner, the use of single-pole breaking units to achieve multipole circuit breakers is described in particular in the Patents FR-A-2,682,531, U.S. Pat. No. 6,448,522 B1, and WO 00/30228 A1. Each single-pole breaking unit constitutes a breaking sub-assembly housed in an enclosure forming the case of the multipole circuit breaker. Each pole of the circuit breaker comprises at least one single-pole unit with at least one rotary contact associated to an arc chute. The single-pole breaking unit is contained in a case made from molded plastic material. Electrical connection of the unit to the rest of the device is performed by means of two connecting pads connected to the stationary contacts.

One of the advantages of such modular systems comprising said breaking units is in particular the reduction of the circuit breaker manufacturing and assembly cost.

The arrangement or positioning of the single-pole breaking units inside the multipole circuit breaker may vary from one embodiment to the other. Depending on the position of the breaking units, large positioning stresses of the units between one another may exist. In addition, the operating mechanism of the units and the mechanical connections between the movable parts of the different units sometimes require high precision operations.

The Patent WO 00/30228 A1 presents a multipole circuit breaker comprising breaking units aligned with respect to one another. This alignment is performed along an axis perpendicular to the mains connection busbar to which the multipole circuit breaker is connected. This arrangement of the single-pole units enables the dimensions of the multipole circuit breaker to be reduced depending on its width but imposes non-negligible manufacturing and operating constraints. This arrangement involves an increase of the lengths of copper required for connecting the different units to the contact clamps that are fixed to the corresponding bars. These excessive lengths of conducting wire are responsible for heating of the device when high electric currents flow through the latter. In addition, control of the units is performed by a mechanical control system formed by rods the excessive lengths whereof make the system mechanically more complex, less dependable and having a longer response time Furthermore, recovery, removal and filtering of the breaking gases are complex. Due to their mutual arrangement and separating distance, each breaking unit does in fact have to be associated to a removal system. In addition, the distance between the bars of the mains connection busbar is greater than that of a circuit breaker whose units are placed side by side.

The Patents FR-A-2,682,531 or U.S. Pat. No. 6,448,522 B1 present multipole circuit breakers where all the breaking units are positioned side by side. These solutions present the interest of having breaking unit operating mechanisms having simplified and dependable mechanical links. However, the increased width of this type of multipole circuit breaker in comparison with the solution described in the document WO 00/30228 A1 may be a drawback when the electric panels are limited in size and have to contain several multipole circuit breakers.

SUMMARY OF THE INVENTION

One object of the invention is therefore to remedy the shortcomings of the state of the art so as to propose a multipole circuit breaker of reduced dimensions and simplified manufacture. Another object of the invention is to propose a circuit breaker the mechanical link whereof between the units is simplified.

A multipole circuit breaker according to the invention comprises breaking units grouped on two superposed layers, at least one layer comprising at least one pair of units, the operating mechanism comprising mechanical connecting means to simultaneously actuate the single-pole breaking units of each layer.

In a particular embodiment, the breaking unit(s) of each layer comprise at least one connecting rod coupled to at least one crank, the cranks of each layer are connected to one another by an operating rod, the operating mechanism simultaneously actuating the cranks of the single-pole breaking units.

Advantageously, the circuit breaker is formed by at least three single-pole breaking units constituted by a pair of units grouped on a first layer and one unit on a second layer.

According to a development of the invention, the circuit breaker is formed by four single-pole breaking units constituted by a first pair of units on a first layer of units and a second pair of units on a second layer.

Preferably, the bottom surfaces of the breaking units of a first layer are respectively adjoined to the bottom surfaces of the breaking units of a second layer.

Advantageously, the two layers of units are offset with respect to one another in the direction of the longitudinal axis of the units to form a removal column of the gases emanating from bottom exhaust openings of the breaking units.

According to an embodiment of the invention, the longitudinal axis of the gas removal column is perpendicular to the longitudinal axes of the breaking units.

Preferably, the difference of the respective lengths of the connecting bars for connection to the mains connection busbar of the units of one and the same pair is substantially equal to the distance separating said bars.

According to a development of the invention, a lug placed on the bottom part of the front face of the circuit breaker case on the one hand enables the circuit breaker to be positioned in a location of an electric panel and also enables said circuit breaker to be rotated so as to progressively connect the contact clamps onto the mains connection busbar, the axis of rotation around which the circuit breaker moves then extending perpendicularly to the side faces of the circuit breaker.

Preferably, the connection terminals or spade connectors are connected and positioned with respect to the first connecting bars in such a way that there exists an angle of clearance between the plane of the front surface of the circuit breaker and the axis of the conductors connected to said connection terminals or spade connectors.

A protection rail according to a development of the invention is positioned on the mains connection bars and comprises at least three parallel series of aligned holes, each series being placed respectively facing a mains connection bar and enabling contact clamps to pass and to be fixed onto said circuit breaker bars as defined above.

Preferably, the aligned holes of a series are spaced apart from one another by a pitch equal to the distance separating two contact clamps of one and the same pole of a circuit breaker.

BRIEF DESCRIPTION OF THE DRAWINGS

Other advantages and features will become more clearly apparent from the following description of a particular embodiment of the invention, given as a non-restrictive example only, and represented in the accompanying drawings in which.

DETAILED DESCRIPTION OF AN EMBODIMENT

Figure 1:
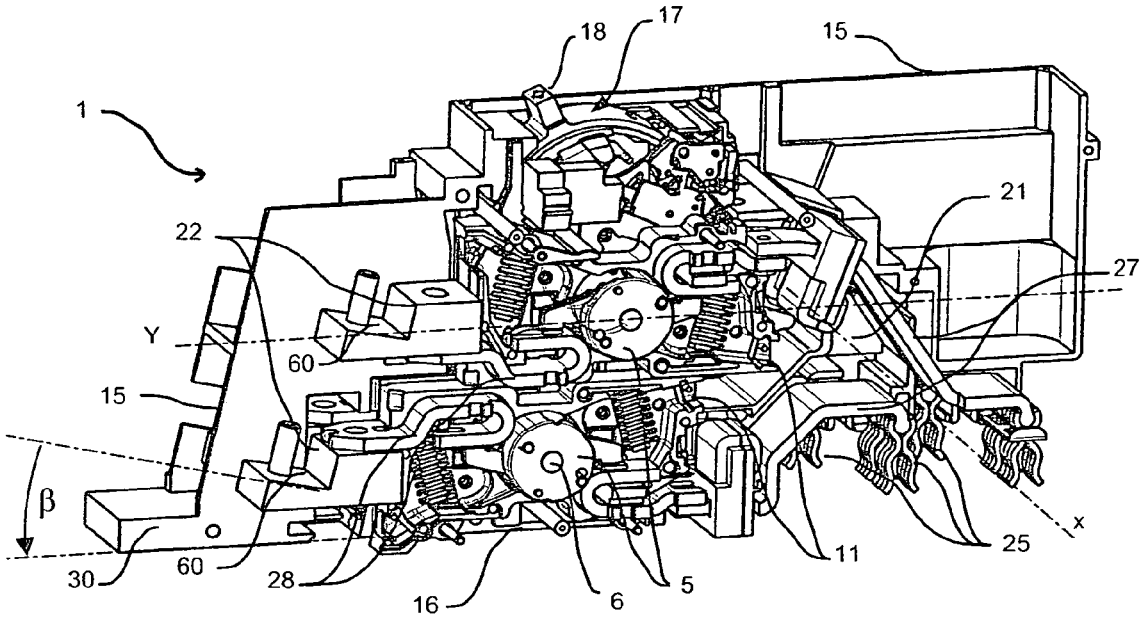
FIG. 1 is an internal perspective view of a four-pole circuit breaker according to an embodiment of the invention.
Figure 2:
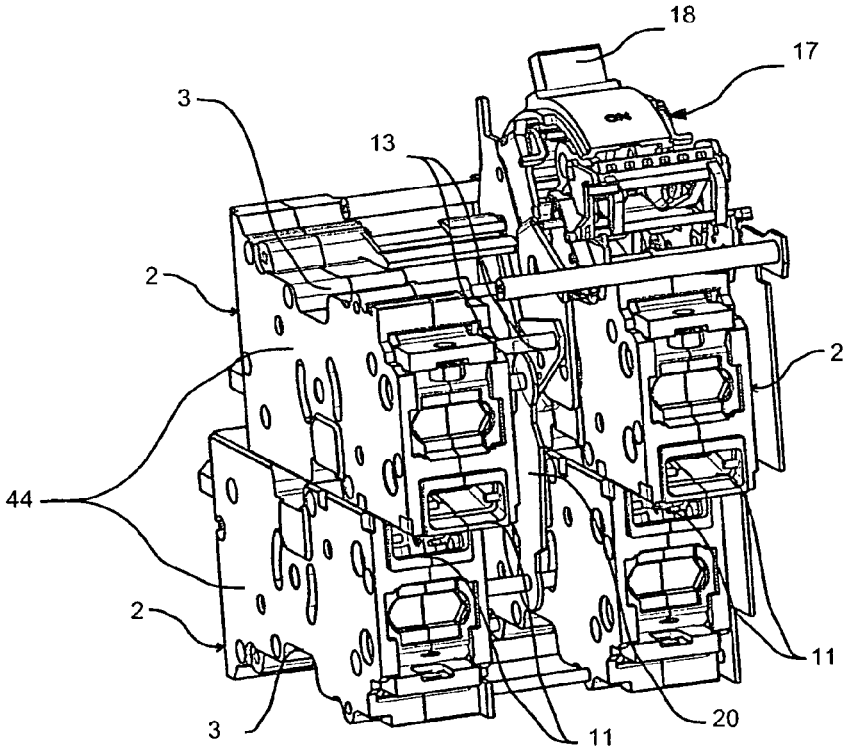
FIG. 2 is a perspective view of the single-pole units and of the operating mechanism associated to the circuit breaker according to FIG. 1.
Figure 3:
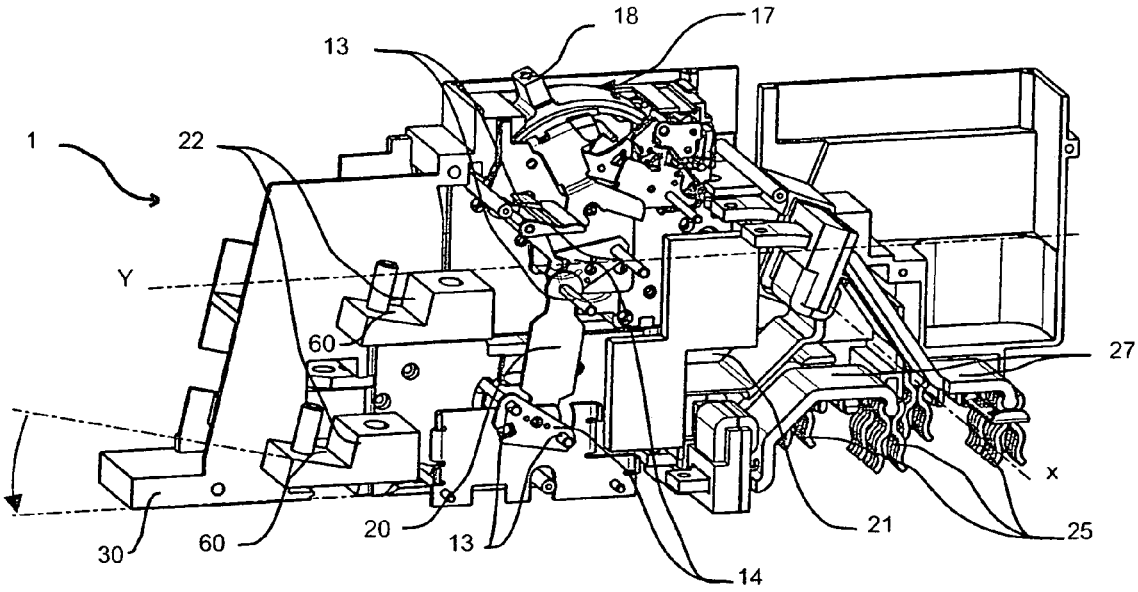
FIG. 3 is a perspective view of a circuit breaker according to an embodiment of the invention.
Figure 4:
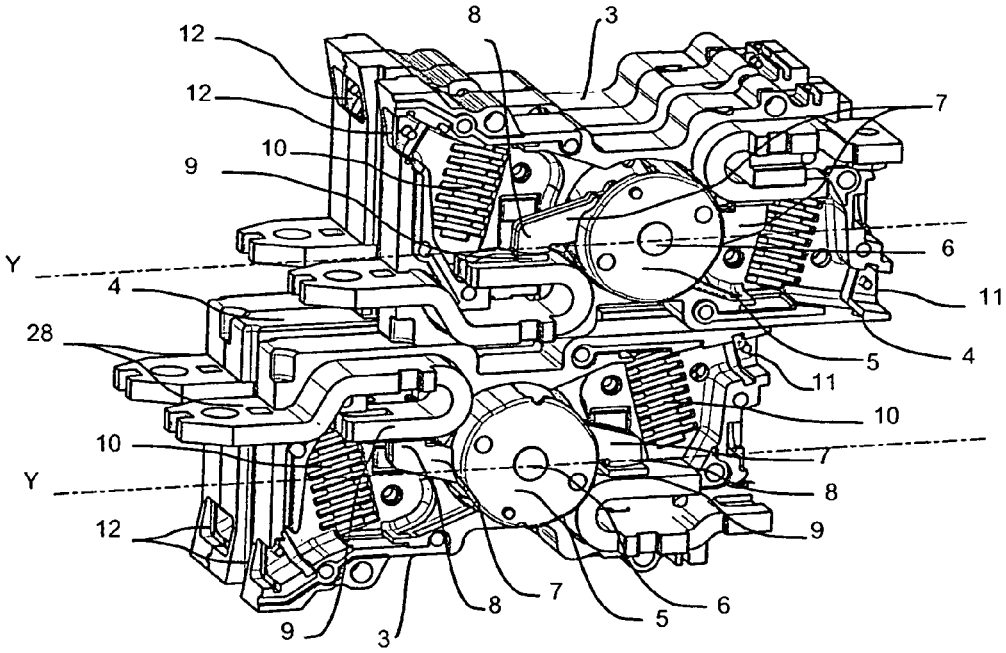
FIG. 4 is a perspective view of the single-pole units arranged on two superposed layers.

According to the embodiment presented in FIGS. 1 to 4, the multipole circuit breaker 1 comprises four single-pole breaking units 2. Each breaking unit 2 comprises a molded case of global parallelepipedic shape having a top surface 3 and a bottom surface 4 and two parallel large side faces 44.

A movable contact bridge is housed inside said units. Said bridge is supported by a bar 5 extending perpendicularly to the parallel large side faces 44. This type of breaking unit is extensively described in the Patent FR-A-2,622,347 filed by the applicant. A rotary double-break contact designed to swivel around a rotation spindle 6 between a closed position and an open position is traditionally observed.

The rotary contact is formed by a pair of lever arms 7 extending between the rotation spindle 6 and two opposite movable contacts 8 respectively operating in conjunction with two stationary contacts 9. Two pairs of contacts each formed by a stationary contact 9 and a movable contact 8 can thus be observed. The contact bridge can swivel around a rotation spindle 6 the axis whereof is perpendicular to the two parallel large side faces 44 of the breaking unit 2. The movable contact bridge is mounted floating on the bar 5 by means of two opposite springs.

It is naturally clear that any other device, in particular a single-break device, can be used.

Each pair of contacts is associated to an arc chute 10 with deionizing plates. At the rear of each arc chute there is provided an opening for the exhaust gases to escape to the outside of the arc chute 2. Each breaking unit thus comprises two openings. A first opening 12 is situated close to the top surface 3 and a second opening called the bottom opening 11 is situated close to the bottom surface 4 of the breaking unit 2.

The single-pole breaking unit is an independent unit forming one of the poles of the circuit breaker 1. Associating four single-pole units 2 enables a four-pole circuit breaker to be achieved. Associating three single-pole units enables a three-pole circuit breaker to be achieved.

In the case of a four-pole circuit breaker, the single-pole breaking units 2 are arranged side by side in pairs, adjoined by their large side faces 44. The bars 5 of two breaking units of a pair are mechanically joined by at least one connecting rod 13, which rod extends parallel to the rotation spindle 6 of said bars 5. In the embodiment, two connecting rods 13 are used. Said rods 13 are eccentric with respect to the rotation spindle 6. The connecting rods 13 are joined by means of a crank 14 comprising two opposite arms, a connecting rod 13 passing through each arm. The rotation axis of the crank is aligned with the rotation spindle 6 of the bars 5.

The two pairs of single-pole breaking units are themselves adjoined via the bottom surfaces 4 of the breaking units 2. The four single-pole breaking units assembled on two superposed layers thus form a compact module of global parallelepipedic shape composed of two upper units and two lower units respectively arranged on an upper layer and a lower layer. The units of the upper layer are facing the rear face 15 of the case of the circuit breaker 1 and inversely the units of the lower layer will be facing the front face 16 of the circuit breaker 1.

An operating mechanism 17 is fixed onto the top face 3 of one of the single-pole breaking units of the upper layer. This mechanism 17 has an operating crank 18 and a toggle. In addition, it comprises two external metal flanges extending parallel to one another and separated by a distance corresponding substantially to the width of a single-pole breaking unit. The operating mechanism 17 is accessible via an opening 70 made on the rear face 15 of the case of the multipole circuit breaker 1.

The opening or closing operating mechanism 17 comprises mechanical connection means to simultaneously actuate the single-pole breaking units of each layer. Said mechanism acts directly on the crank 14 of the breaking units of the upper layer placed in contact with said mechanism. Operation of the breaking units of the lower layer is performed by means of an operating rod 20 respectively connecting the cranks 14 of the breaking units of the two layers. Said operating mechanism 17 thus commands simultaneous opening and closing operations of the contacts 8, 9 of the set of breaking units 2.

The two layers of breaking units 2 are offset from one another in a direction parallel to the longitudinal axis Y of the breaking units. This offset of the units creates a free space having the form of a column 21 extending between the side faces 40 of the case of the circuit breaker 1. The axis X of the column 21 is perpendicular to the longitudinal axis Y of said units. In this geometric configuration, the bottom gas exhaust openings 11 placed near to the four bottom surfaces 4 of the breaking units 2 are in direct communication with said column 21. The gases are thus collected, channelled and removed to the outside of the case of the circuit breaker 1.

Figure 5:
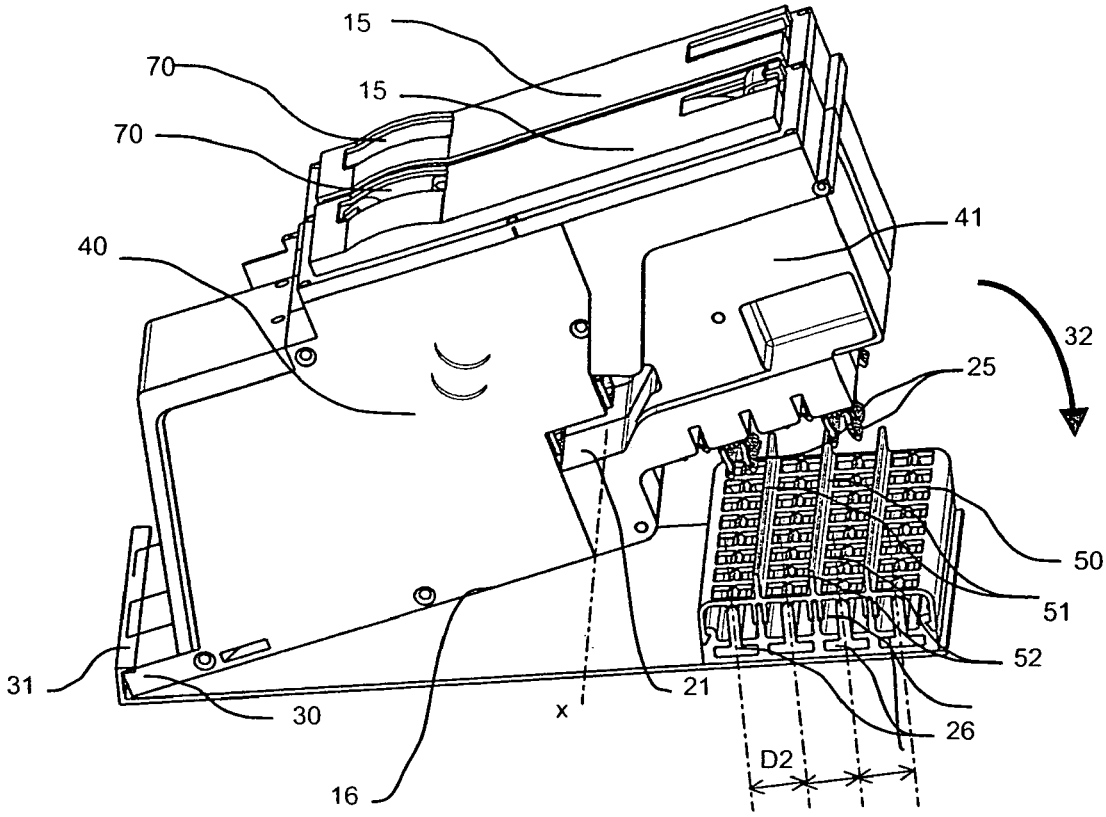
FIGS. 5 to 7 represent in the form of simplified diagrams two circuit breakers according to the invention at the moment they are positioned in an electric panel.
Figure 6:
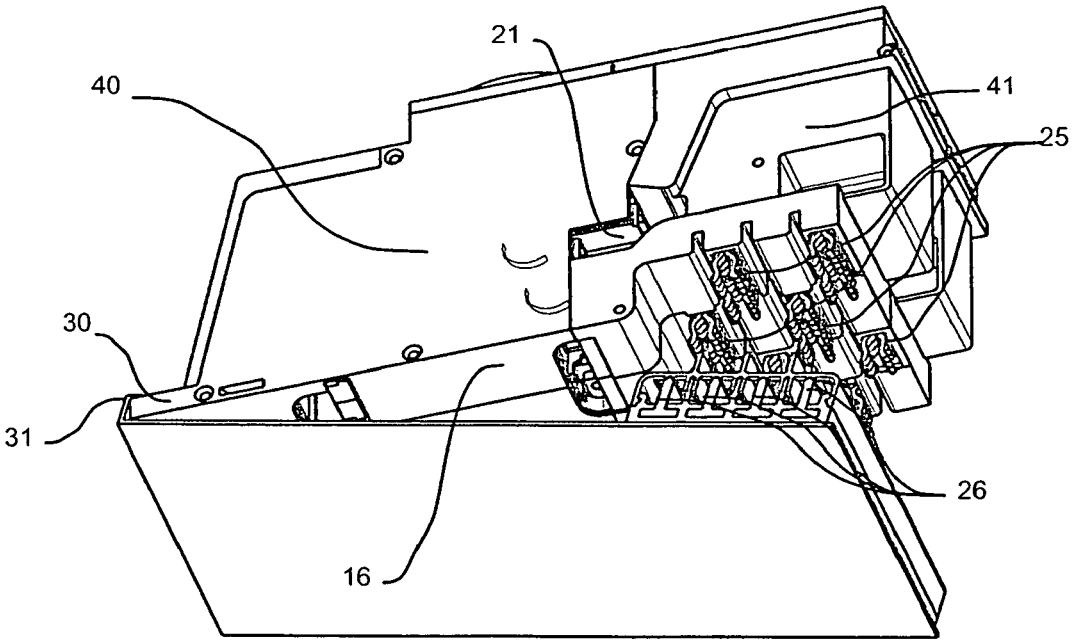
Figure 7:
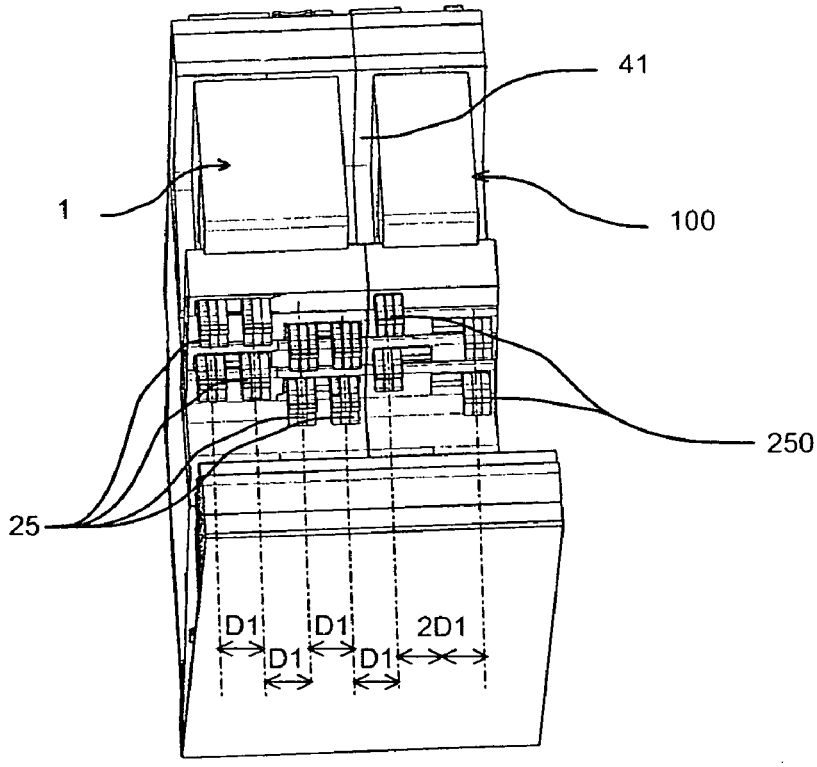

If several circuit breakers are positioned side by side in an electric panel, it is then observed according to FIGS. 5 to 7 that all the longitudinal axes X of the removal columns of said circuit breakers are aligned. The gases escaping from a first circuit breaker will then flow through the other circuit breakers via their column 21 before being released to the outside.

If an isolated circuit breaker is divided into compartments by means in particular of plates placed on each side of its side faces 40, the gases escaping from the column 21 are then directed to the outside of the compartment by means of volumes 41 specially arranged in the side faces 40 of each circuit breaker case.

A first series of stationary contacts 9 of the single-pole breaking units 2 is connected to connection terminals or spade connectors 22 by first connecting bars 28. These connection terminals or spade connectors 22 are used for load-side electrical connection with for example feeder lines. In addition, they are accessible from the bottom part of the rear face 15 of the circuit breaker 1.

The connection terminals or spade connectors 22 are connected and positioned with respect to the first connecting bars 28 in such a way that there exists a clearance angle β between the plane formed by the front surface 16 of the circuit breaker 1 and the axis of the conductors connected to said terminals or spade connectors 22. In practice, the contact surface 60 of the spade connectors 22 whereon the conductors are positioned is not parallel to the plane formed by the front face 16 of the circuit breaker 1. Said contact surface 60 then forms an angle β with said surface 16. In the case of use of connection terminals 22 of cylindrical or almost cylindrical shape, the longitudinal axis of said terminals 22 forms an angle β with the front surface 16 of the circuit breaker 1.

This particular orientation is useful for good clearance of the conductors when disconnection thereof is performed. In addition, this particular arrangement of the connection terminals or spade connectors 22 in particular enables the distance between the rear surface 15 and the front surface 16 of said circuit breaker 1 to be reduced.

A second series of stationary contacts 9 of the single-pole breaking units 2 is connected to contact clamps 25 by second connecting bars 27. The two connecting bars 27 of the units of one and the same pair are of different lengths. The difference of length is substantially equal to the distance D2 separating said mains connection bars 26. In the embodiment described, the connecting bars 27 of the same pair of units are composed of a first part of the same length and the same shape and a second part of different length, said difference being equal to the distance D2 separating the mains connection bars 26.

The connection clamps 25 are designed for line-side electrical connection of the circuit breaker to the electrical power supply system. They are placed on the front face 16 of the circuit breaker case. Moreover, said circuit breaker clamps 25 are in direct connection with a mains connection busbar 26 placed in the electric power supply panel. These connection bars 26, generally made of aluminium or copper, are perpendicular to the side faces 40 of said case of the circuit breaker 1.

Fitting the circuit breaker in the electric power supply panel is performed in the following manner. In a first stage, a lug 30 placed on the bottom part of the front face 16 of the case of the circuit breaker 1 is plugged into a location 31 of the electric panel. Rotation of the circuit breaker in the direction of the arrow 32 of FIG. 5 is then performed in order to connect the clamps 25 onto the bars 26 of the mains connection busbar. The axis of rotation around which the circuit breaker moves then extends perpendicularly to the side faces 40 of the circuit breaker 1. The circuit breaker clamps 25 are arranged in such a way that they connect successively and progressively onto the mains connection busbar. This progressive connection enables the useful force for fitting the circuit breaker in the electric panel to be reduced.

Once the circuit breaker has been plugged in, locking means, positioned in opposite manner to the lug 30 on the top part of the rear face 15 of the case of the circuit breaker 1 enable the circuit breaker to be fixed rigidly to the electric panel.

According to a first alternative embodiment, the number of clamps per pole can be modulated according to the circuit breaker rating. For example, as represented in FIGS. 5 to 7, two clamps 25 are used per pole for a 630 amp rating circuit breaker 1 and only one clamp 250 for a 250 amp rating circuit breaker 100.

When at least two clamps 25 are used per pole of a circuit breaker, the distance between these clamps is equal to D1. In addition, as represented in FIG. 7, when several circuit breakers are connected on the same busbar 26, the distances respectively separating all the clamps plugged onto the same busbar 26 will always be equal to an integer multiple of the distance D1.

According to a second alternative embodiment, in order to limit direct access to the mains connection bars 26, the latter are covered by a protection rail 50. The connection clamps 25 are then connected to the connection bars 26 via openings 52 made on the rail 50. The openings 52 are of substantially rectangular shape and are aligned above the mains connection bars 26.

At least three series of parallel openings 52 are then observed for a three-pole circuit breaker and four parallel series for a four-pole circuit breaker. A strip 51 of insulating material protrudes out from the upper plane of the protection rail 50. This strip 51 enables a better insulation of the clamps 25 to be achieved when the latter are plugged onto the connection bars 26. For a great modularity at the level of installation of an electric panel, the rectangular openings of a series are spaced apart from one another by a pitch the value whereof corresponds to the distance D1 separating the clamps 25 of a circuit breaker pole. The same protection rail 50 thus accommodates circuit breakers of different ratings placed side by side.

Advantageously, the circuit breaker comprises a trip unit which is either integrated in the circuit breaker case or adjoined to the rear surface of said case. The trip unit of electronic or electromechanical type can be common to all the breaking units.

Figure 8:
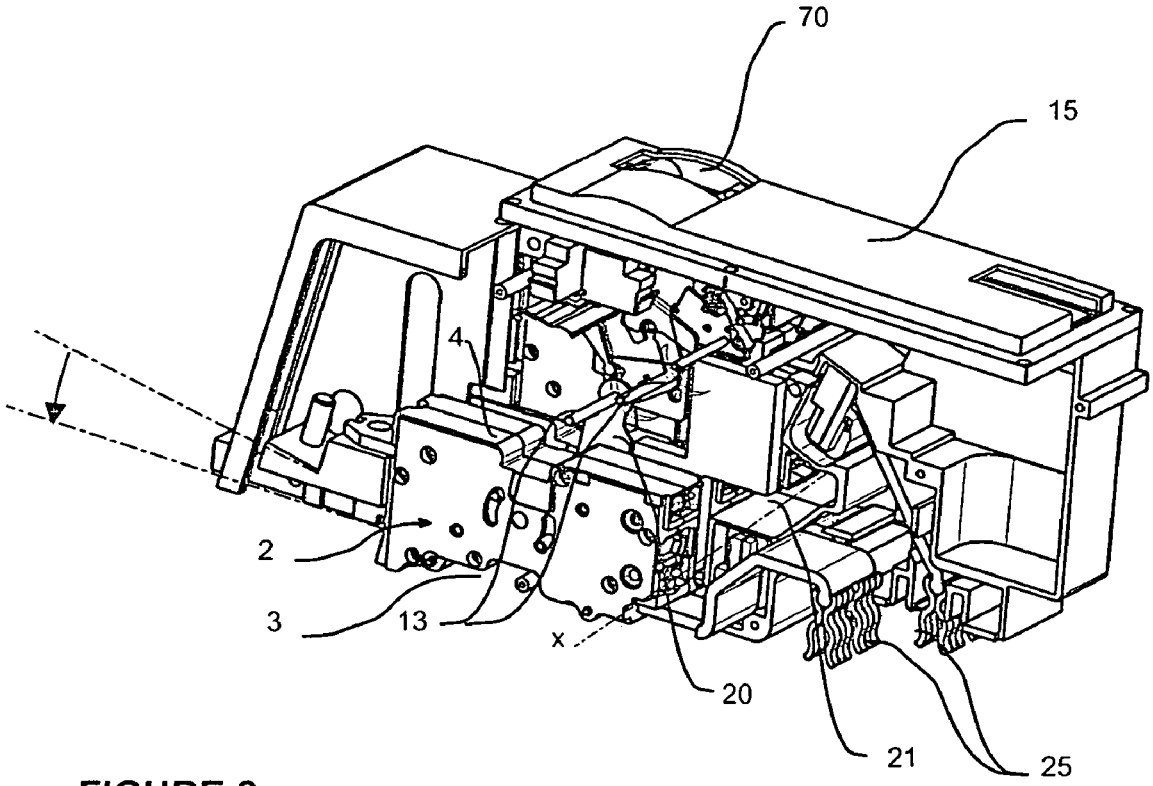
FIG. 8 is a schematic perspective view of a three-pole circuit breaker according to an embodiment of the invention.

According to another alternative embodiment, the multipole breaking device is formed by three single-pole breaking units 2 thus forming a three-pole circuit breaker. Unlike the four-pole circuit breaker described above, the volume occupied by the fourth breaking unit is left vacant or is occupied by a substitution spacer. In the embodiment of this alternative version according to FIG. 8, one of the two units of the upper layer is then eliminated. The single-pole unit insulated from the upper layer comprises a connecting rod 13 which extends parallel to the axis of rotation 6 of the bar supporting the movable contacts 8. In the embodiment, two connecting rods 13 are used. Said rods are eccentric with respect to the axis of rotation of said bar 5. The connecting rods are connected by means of a crank 14 comprising two opposite arms, a connecting rod passing through each arm. The axis of rotation of the crank is aligned with the axis of rotation of the bar 5. The operating mechanism is directly placed on the insulated breaking unit of the upper layer. As for the four-pole circuit breaker, the opening or closing operating mechanism 17 acts directly on the crank of the upper unit. Control of the lower breaking units is performed by means of a control rod 20 respectively connecting the crank of the breaking unit of the upper layer to that of the lower layer.

Said operating mechanism thus commands simultaneous opening or closing operations of the contacts of all the breaking units.

According to an alternative embodiment, the connection terminals or spade connectors 22 are used for line-side electrical connection with for example electrical power supply system incoming lines. The connection clamps 25 in direct connection with a connection busbar 26 are then designed for load-side electrical connection of the circuit breaker.

According to an alternative embodiment, the first series of stationary contacts 9 of the single-pole breaking units are connected to clamps 25 by the first connecting bars 28. The second series of stationary contacts of the single-pole breaking units are also connected to clamps by the second connecting bars 27. Clamps are therefore used for the load-side and line-side connections.

The invention claimed is:

1. Multipole circuit breaker, comprising:

single-pole breaking units each having, respectively, a case with two large side faces and a bottom surface and having at least one movable contact which operates in conjunction with at least one stationary contact, each single-pole breaking unit being electrically independent, an operating mechanism common to all single-pole breaking units to command opening or closing of the contacts of said single-pole breaking units, first line-side electrical connection means, and second load-side electrical connection means, wherein the electrically independent single-pole breaking units are located in a first and a second superposed layers, at least one of the two layers comprising at least one pair of electrically independent single-pole breaking units, each movable contact of each electrically independent single pole being on the same layer, and the operating mechanism comprising mechanical connecting means for simultaneously actuating the single-pole breaking units of both layers.

2. The circuit breaker according to claim 1, wherein the single-pole breaking unit(s) of each layer comprise at least one connecting rod coupled to at least one crank, the cranks of each layer are connected to one another by an operating rod, the operating mechanism simultaneously actuating the cranks of the single-pole breaking units.

3. The circuit breaker according to claim 1, comprising at least three single-pole breaking units comprising a pair of units grouped in a first layer and one unit on a second layer.

4. The circuit breaker according to claim 3, further comprising four single-pole breaking units comprising a first pair of units in a first layer of units and a second pair of units in a second layer.

5. The circuit breaker according to claim 1, wherein the bottom surfaces of the single-pole breaking units of the first layer are adjoined to the bottom surfaces of the single-pole breaking units of the second layer.

6. The circuit breaker according to claim 5, wherein the two layers of units are offset with respect to one another in a direction of a longitudinal axis of the units to form a removal column for gases emanating from bottom exhaust openings of the units.

7. The circuit breaker according to claim 6, wherein a longitudinal axis of the removal column is perpendicular to the longitudinal axes of the breaking units.

8. The circuit breaker according to claim 1, wherein a difference of length between connecting bars of two single-pole breaking units is substantially equal to a distance separating mains connection bars connecting said connecting bars.

9. The circuit breaker according to claim 1, further comprising a lug placed on the bottom part of the front face of the case of the circuit breaker for positioning the circuit breaker in a location of an electric panel and for rotating said circuit breaker to connect the contact clamps onto the mains connection busbar, the axis of rotation around which the circuit breaker moves extending perpendicularly to the side faces of the circuit breaker.

10. The circuit breaker according to claim 1, wherein the connection terminals are connected having an angle of clearance between the front of the circuit breaker and an axis of the conductors connected to said connection terminals.

* * * * *